United States Patent [19]

Coburn

[11] Patent Number: 4,472,988

[45] Date of Patent: Sep. 25, 1984

[54] WEB SLITTING APPARATUS

[75] Inventor: Robert E. Coburn, Warminster, Pa.

[73] Assignee: Molins Machine Company, Inc., Cherry Hill, N.J.

[21] Appl. No.: 422,125

[22] Filed: Sep. 23, 1982

[51] Int. Cl.[3] ..... B26D 7/00

[52] U.S. Cl. ..... 83/162; 83/449; 83/438; 226/199

[58] Field of Search ..... 83/478, 443, 446, 448, 83/449, 438, 162; 226/196, 199; 271/264

[56] References Cited

U.S. PATENT DOCUMENTS

| | | | |
|---|---|---|---|
| 3,034,388 | 5/1962 | Stoothoff | 83/446 |
| 3,046,833 | 7/1962 | Harvey | 226/199 |
| 3,525,281 | 8/1970 | McGill | 83/443 |
| 3,673,905 | 7/1972 | Kono | 83/443 |
| 3,851,811 | 12/1974 | Turner | 226/199 |
| 4,214,495 | 7/1980 | Coburn | 83/425.4 |
| 4,410,122 | 10/1983 | Frye et al. | 226/199 |

*Primary Examiner*—James M. Meister
*Assistant Examiner*—J. L. Knoble
*Attorney, Agent, or Firm*—Seidel, Gonda & Goldhammer

[57] ABSTRACT

Web slitting apparatus is provided with a web guide below the web path. The web guide is moveable between operative and inoperative positions. In the inoperative position, the web guide has a portion for supporting a central portion of the web when it is desired to process a web as mill run board.

8 Claims, 2 Drawing Figures

WEB SLITTING APPARATUS

BACKGROUND OF THE INVENTION

The present invention is an improvement over structure disclosed in U.S. Pat. No. 4,214,495. As shown in FIG. 8 of said patent, web guides are provided for guiding the web. The apparatus in said patent is arranged to automatically slit and score a web. On occasion it is desired to process mill run board, that is board which is not scored. Mill run board is trimmed at its side edges to a desired width.

When mill run board is being processed, and has a substantial width, the board tends to bow downwardly in its center due to its weight. When the mill run board leaves the slitter, it will be trimmed to a width which is greater than that desired. The present invention is directed to recognition of the problem with a solution based on using already existing components to perform an additional function.

SUMMARY OF THE INVENTION

The present invention is directed to slitting apparatus for longitudinally slitting a web by blades on a horizontally disposed transverse shaft. At least one web guide is supported below the web path. The web guide is moveable from a first operative position wherein one portion of the web guide is adjacent the web path and a second inoperative position wherein said one portion is remote from the web path. The web guide has a second portion spaced from the first portion and which is disposed adjacent the web path for supporting a central portion of a web when the web guide is in its second inoperative position and when it is desired to process the web as mill run board.

Various objects and advantages of the present invention will be set forth hereinafter.

For the purpose of illustrating the invention, there is shown in the drawings a form which is presently preferred, it being understood, however, that this invention is not limited to the precise arrangements and instrumentalities shown.

DETAILED DESCRIPTION

Figure 1:
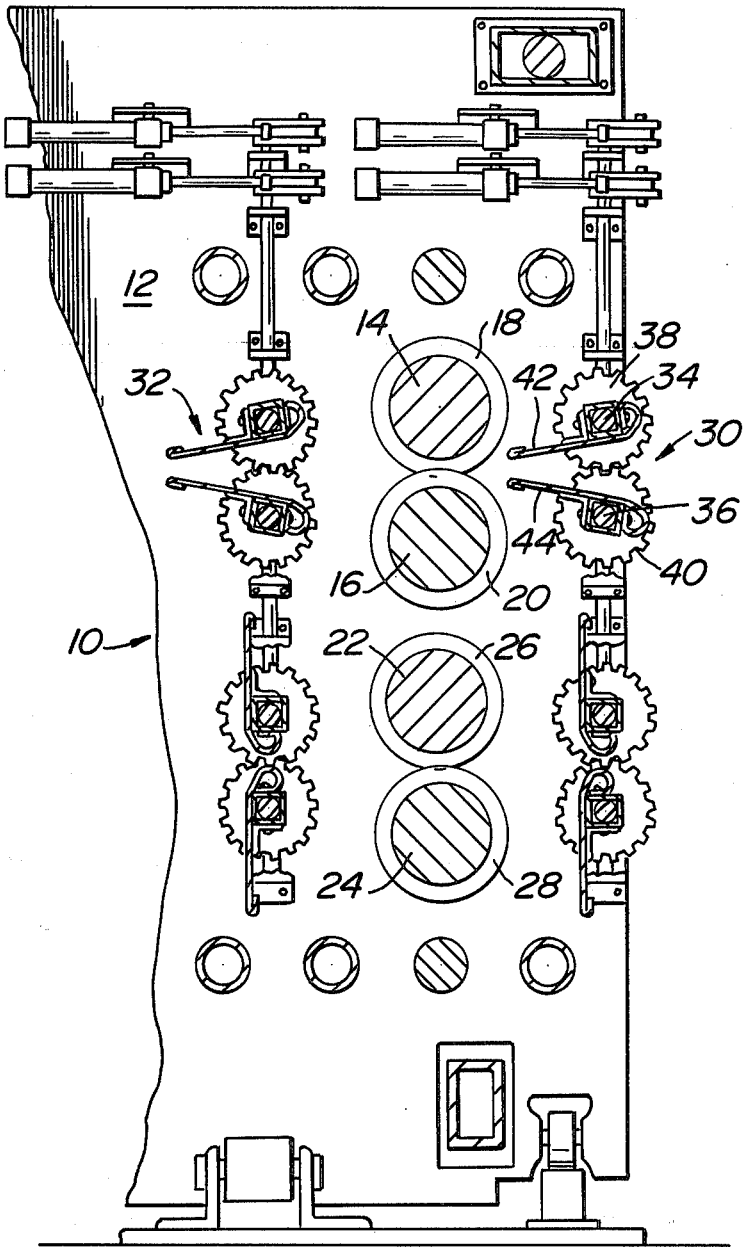
FIG. 1 is a sectional view corresponding to FIG. 8 in the above-mentioned patent.

Referring to the drawing in detail, wherein like numerals indicate like elements, there is shown in FIG. 1 the slitting portion of a slitter scorer for processing a web of corrugated paperboard. The slitting apparatus is designated generally as 10 and includes a frame 12 adapted to be adjusted transversely of the web. The frame 12 supports an upper set of slitting shafts 14, 16. Shaft 14 has a plurality of slitting blades 18. Shaft 16 has a plurality of slitting blades 20. The blades 18 and 20 are arranged in sets. The frame 12 also supports a lower set of slitting shafts 22, 24. Shaft 22 has a plurality of slitting blades 26. Shaft 24 has a plurality of slitting blades 28. The blades 26 and 28 are arranged in sets.

The structure associated with the upper slitting shafts 14, 16 and the lower slitting shafts 22, 24 is identical. Hence, only the structure associated with upper slitting shafts 14, 16 will be described in detail.

The direction of movement of the web is from right to left in FIG. 1. Upstream of the slitting shafts 14, 16 there is provided a web guide device 30. A similar web guide device 32 is provided downstream from the slitting shafts 14, 16. Each web guide device is identical. Hence, only the web guide device 30 will be described in detail.

Figure 2:
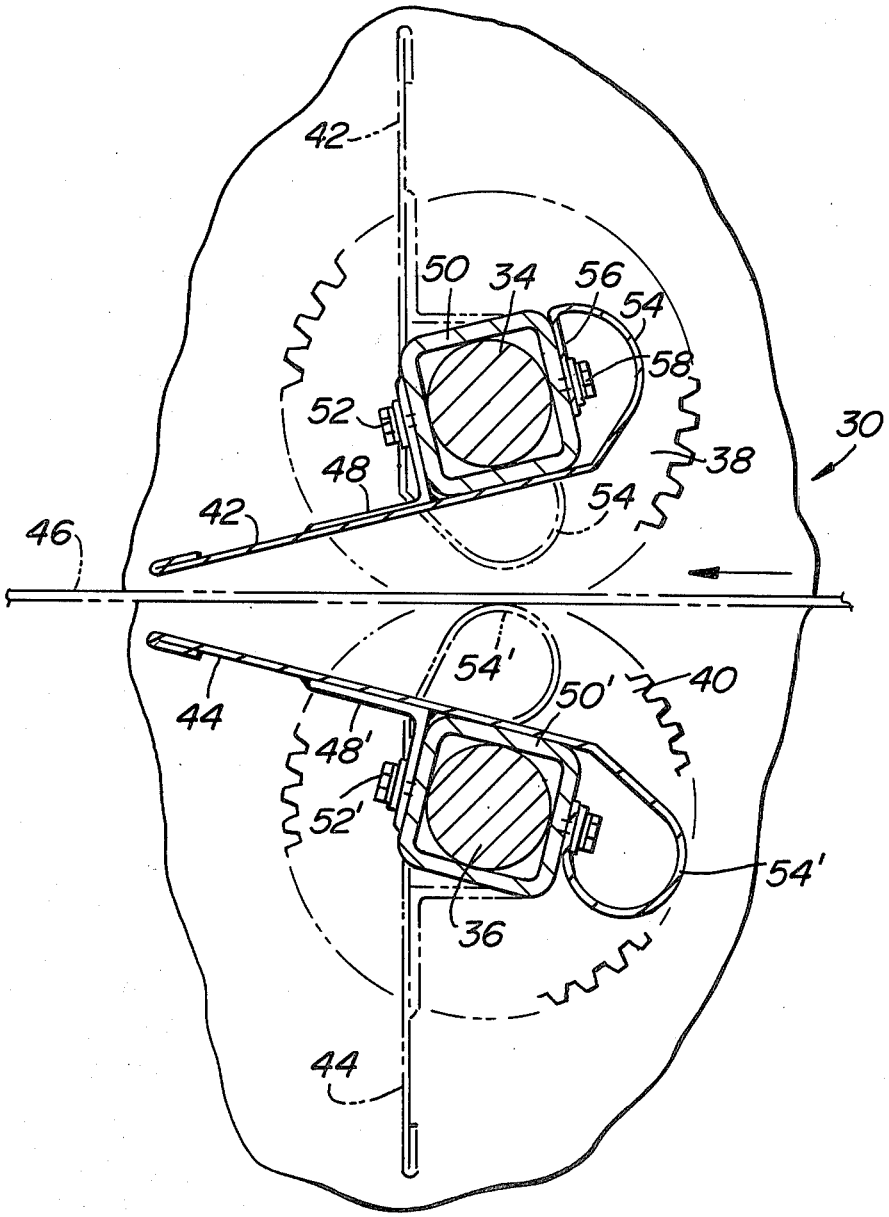
FIG. 2 is an enlarged detailed view of a portion of FIG. 1 showing the web.

Referring to FIG. 2, the web guide device 30 includes a pair of transversely disposed shafts 34 and 36 rotatably supported by the ends of frame 12. A gear 38 is fixed to shaft 30. A gear 40 is fixed to shaft 36. The gears 38, 40 are in mesh. Shaft 34 supports an upper web guide 42. Shaft 36 supports a lower web guide 44. The web guides 42 and 44 converge toward the web path and terminate in a free end between which the web will be guided with minimum flutter in an up and down direction. The web guides 42 and 44 are made from sheet metal and may have any desired length. I prefer to provide each guide 42, 44 with a length slightly less than the length of their shafts so as to extend across the machine. If desired, it is within the scope of the invention to provide a plurality of web guides on each of the shafts 34 and 36 at spaced locations along the length thereof. At the free end or first portion, the web guides 42, 44 are bent back on themselves so as to present rounded surfaces for contact with the web designated 46.

The web guides 42 and 44 may be secured to the shafts 34 and 36 respectively in any desired manner. It is preferred to provide a rectangular casing 50 for the shaft 34 and a corresponding casing 50' for the shaft 36. This facilitates securing the web guide 42 to the casing 50 by means of a discrete L-shaped bracket 48 and bolt 52. Web guide 44 is similarly connected to the casing 50' by a similar bracket 48' and bolt 52'.

Each web guide 42 is provided with a second portion 54 remote from its free end. Each portion 54 is curved and has a flat end portion 56 bolted to the casing 50 by way of bolt 58. Curved portions 54' on the web guides 44 are similarly provided.

By rotating the meshed gears 38, 40, the casings cause the web guides to pivot about 100° from the operative position shown in solid lines in FIG. 2 to the inoperative position shown in phantom FIG. 2 for processing mill run board. When processing mill run board, the slitting blades 18, 20, 22, and 28 will have been shifted to one end of their respective shafts so as to be transversely disposed of the web 46. When the web guide 44 is moved to its phantom position as shown in FIG. 2, the curved portion 54' will move to the phantom position and support the central portion of the web 46.

When processing mill run board, the central portion of the web 46 will be maintained flat whereby errors in trimming the edges of the web 46 will not occur. Thus, the trimmed web 46 will not be wider than desired due to a curved central portion of the web 46. This feature is attained without making any changes in the apparatus disclosed in the above-mentioned patent other than the addition of the curved portions such as portions 54 and 54'. Another advantage of the present invention is the simplicity in which the problem has been solved. When mechanically or manually threading a leading edge of web 46, the curved portions 54, 54' of each web guide device cooperate to properly guide the web to its intended path.

The present invention may be embodied in other specific forms without departing from the spirit or essential attributes thereof and, accordingly, reference should be made to the appended claims, rather than to the foregoing specification, as indicating the scope of the invention.

I claim:

1. In a slitting apparatus wherein a web is to be slit longitudinally by at least one blade on a horizontally disposed shaft with at least one web guide adjacent to and below the web path, the web guide being moveable from a first position wherein one portion of the web guide is adjacent the web path and a second position wherein said one portion is remote from the web path, said web guide having a second portion which is spaced from the first portion and disposed adjacent the web path for supporting a central portion of a web when the web guide is in its second position and when it is desired to process a web as mill run board.

2. Apparatus in accordance with claim 1 wherein said two portions are integral in one piece, said first portion being straight and at the downstream end of said web guide, said second portion being curved and at the upstream end of said web guide.

3. Apparatus in accordance with claim 2 including means separately securing each of said portions to a shaft below the web path.

4. Apparatus in accordance with claim 1 including a pair of slitter shafts supported by a frame, sets of slitter blades on each shaft, said web guide being upstream from said slitter shafts.

5. Apparatus in accordance with claim 1 including a pair of slitter shafts supported by a frame, sets of slitter blades on each shaft, said web guides being downstream from said slitter shafts.

6. Apparatus in accordance with claim 1 including a second identical web guide above the web path, said web guides each being mounted on discrete shafts geared together for movement through an arc of approximately 110°.

7. Slitting apparatus wherein a web is to be slit longitudinally comprising a pair of horizontally disposed slitter shafts having sets of slitter blades, a web guide below a central portion of the web path adjacent said shafts, the web guide being moveable from a first position wherein one portion of the web guide is adjacent the web path and a second position wherein said one portion is remote from the web path, said web guide having a second portion which is spaced from the first portion and disposed adjacent the web path for supporting a central portion of a web when the web guide is in its second position and when it is desired to process a web as mill run board, said first portion being straight, said second portion being curved and said web guide being mounted on a shaft for movement through an arc of approximately 100°.

8. Apparatus in accordance with claim 7 wherein said second portion is at the upstream end of said web guide, said first portion being at the downstream end of said web guide and being inclined upwardly toward the web path when said web guide is in its first position.

* * * * *